United States Patent [19]

Reichert

[11] 4,102,252

[45] Jul. 25, 1978

[54] CONTINUOUS MOTION APPARATUS AND METHOD FOR SEALING CARTONS

[75] Inventor: Donald G. Reichert, Tarpon Springs, Fla.

[73] Assignee: ABC Packaging Machine Corporation, Tarpon Springs, Fla.

[21] Appl. No.: 781,157

[22] Filed: Mar. 25, 1977

[51] Int. Cl.[2] ..... B31B 1/64

[52] U.S. Cl. ..... 93/36.3; 93/44; 100/178

[58] Field of Search ..... 93/36.3, 44, 44.1 R, 93/36 SQ; 53/387, 374, 375; 100/178, 222

[56] References Cited

U.S. PATENT DOCUMENTS

| | | | |
|---|---|---|---|
| 623,586 | 4/1899 | Webb | 93/44 X |
| 956,392 | 4/1910 | Martin | 93/44 |
| 2,014,555 | 9/1935 | Chekian | 53/387 X |
| 3,620,138 | 11/1971 | Neal et al. | 93/36.3 |

*Primary Examiner*—James F. Coan

*Attorney, Agent, or Firm*—Newton, Hopkins & Ormsby

[57] ABSTRACT

Empty cartons are delivered by a high speed carton erecting apparatus to a carton squaring and bottom flap folding station. At this station, the cartons are engaged in succession by continuously moving extensible ram units having flap compression plates and these units complete the bottom flap sealing operation while the empty cartons are being advanced away from the erecting apparatus at a speed consistent with the output of the latter. Upon completion of the flap sealing operation, the ram units move out of the cartons and continue their cycle of operation with additional oncoming cartons from the erecting apparatus.

16 Claims, 8 Drawing Figures

CONTINUOUS MOTION APPARATUS AND METHOD FOR SEALING CARTONS

BACKGROUND OF THE INVENTION

In the prior art, cartons are erected from collapsed blanks by comparatively high speed machines such as shown in U.S. Pat. Nos. 3,763,750 and 3,828,659. After leaving the erecting machine, the bottom flaps of the erected cartons are folded and sealed by other apparatuses exemplified by U.S. Pat. Nos. 3,482,489; 3,620,138 and 3,902,406.

A serious problem arises as a result of the inability of the flap sealing apparatus or machine to process cartons at a sufficient speed to keep up with the output of the high speed carton erecting machine. As a result, additional sealing machinery must be employed at increased expense and loss of floor space or the erecting machinery must be shut down periodically to avoid carton pile-up. Thus, the prior art arrangements are not in the interest of good economy and continuous smooth and efficient manufacturing operation.

The objective of this invention is, therefore, to eliminate the above deficiencies of the prior art through the provision of apparatus in the nature of an addition to the customary high speed carton erecting machine which will be capable of sealing the bottom flaps of cartons as they are delivered by the erecting machine at the same speed as the delivery speed of the erecting machine, thus avoiding carton pile-up. The present invention accomplishes this objective by means of a very simple continuous motion apparatus and method which involves engaging each carton in succession at a carton squaring and lower flap folding station with continuously traveling carton flap compression units driven by endless conveyor means in predetermined spaced relation to achieve timing coordinated with the delivery of cartons from the erecting machine. The continuously moving compression units or rams travel with the empty cartons away from the squaring and flap folding station and apply flap sealing pressure to the bottoms of the cartons while they are moving on a conveyor support to a discharge station where the flap sealing operation has been completed following the application of pressure for a sufficient time. At this station, the continuously traveling compression units separate from the cartons and continue their movement to process oncoming erected cartons in the same manner. Glue is applied to the lower flaps of the cartons in advance of the carton squaring and flap folding station, or in a variant of the invention adjacent to an intermediate transfer and timing station where the lower flaps are folded during uninterrupted movement of the cartons.

Other features and advantages of the invention will become apparent during the course of the following detailed description.

DETAILED DESCRIPTION

Figure 1:
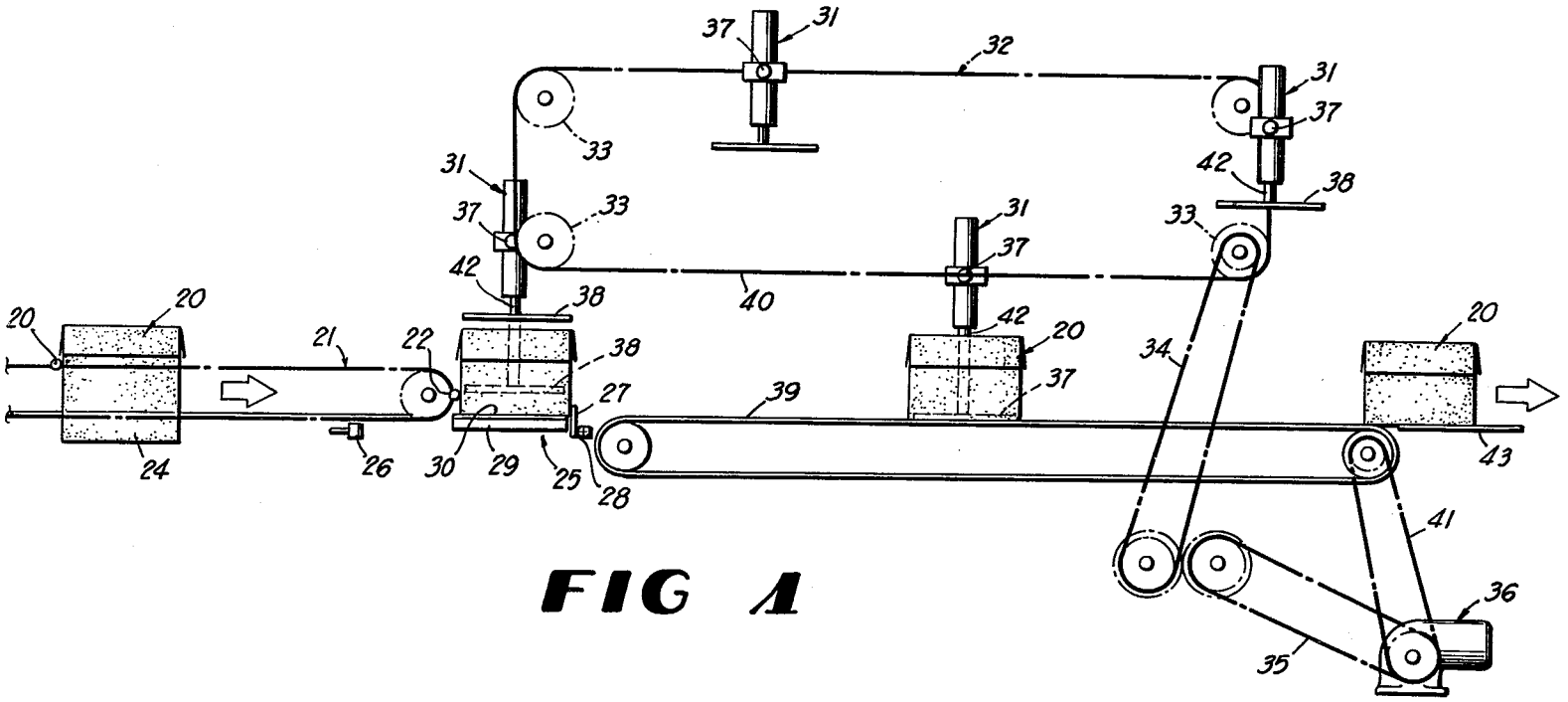
FIG. 1 is a partly schematic side elevation of a continuous motion carton sealing apparatus arranged near the discharge end of a carton erecting machine and used in the practice of the method.

Referring to the drawings in detail wherein like numerals designate like parts, and initially considering FIGS. 1 through 4, cartons 20 are delivered in succession from a high speed carton erecting machine by a moving conveyor element 21 of the erecting machine having spaced carton pushers 22 thereon. The erected cartons 20 slide along on a horizontal support element 23, FIG. 3, and only their inner bottom flaps are folded and resting on the element 23. Their outer bottom flaps 24 remain unfolded and depending from the bottoms of the empty cartons.

Figure 4:
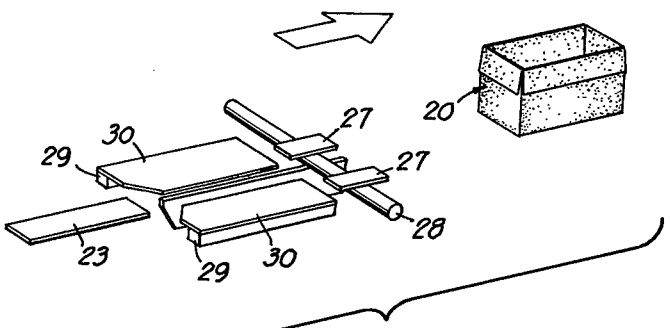
FIG. 4 is a similar view of the same station with the components thereof in a second position of use.
Figure 3:
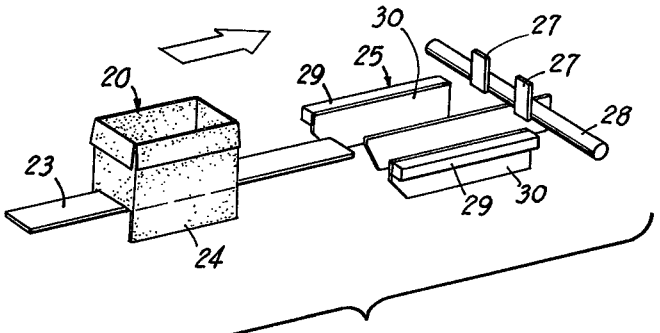
FIG. 3 is a fragmentary perspective view of an intermediate carton squaring and bottom flap folding station in one position of use.

In this manner, the cartons are delivered in succession to a carton squaring and flap folding station 25 shown particularly in FIGS. 3 and 4. Upstream of this station 25 a glue applying means 26 of a conventional type applies glue to the interior faces of the outer bottom flaps 24 while they are moving with the conveyor means 21. At the station 25, upstanding squaring stops 27 on a rocker shaft 28 interrupt the movement of the cartons 20 briefly to square them in relation to their line of travel. At this brief dwell interval, while each carton is supported by rails 29 at the station 25, the bottom flaps 24 enter between flap folding blades 30 which are vertically disposed initially, FIG. 3, and these blades 30 then move to horizontal positions, as shown in FIG. 4, and in so doing, effect the upward folding of the outer bottom flaps 24 of each carton at the station 25.

Figure 2:
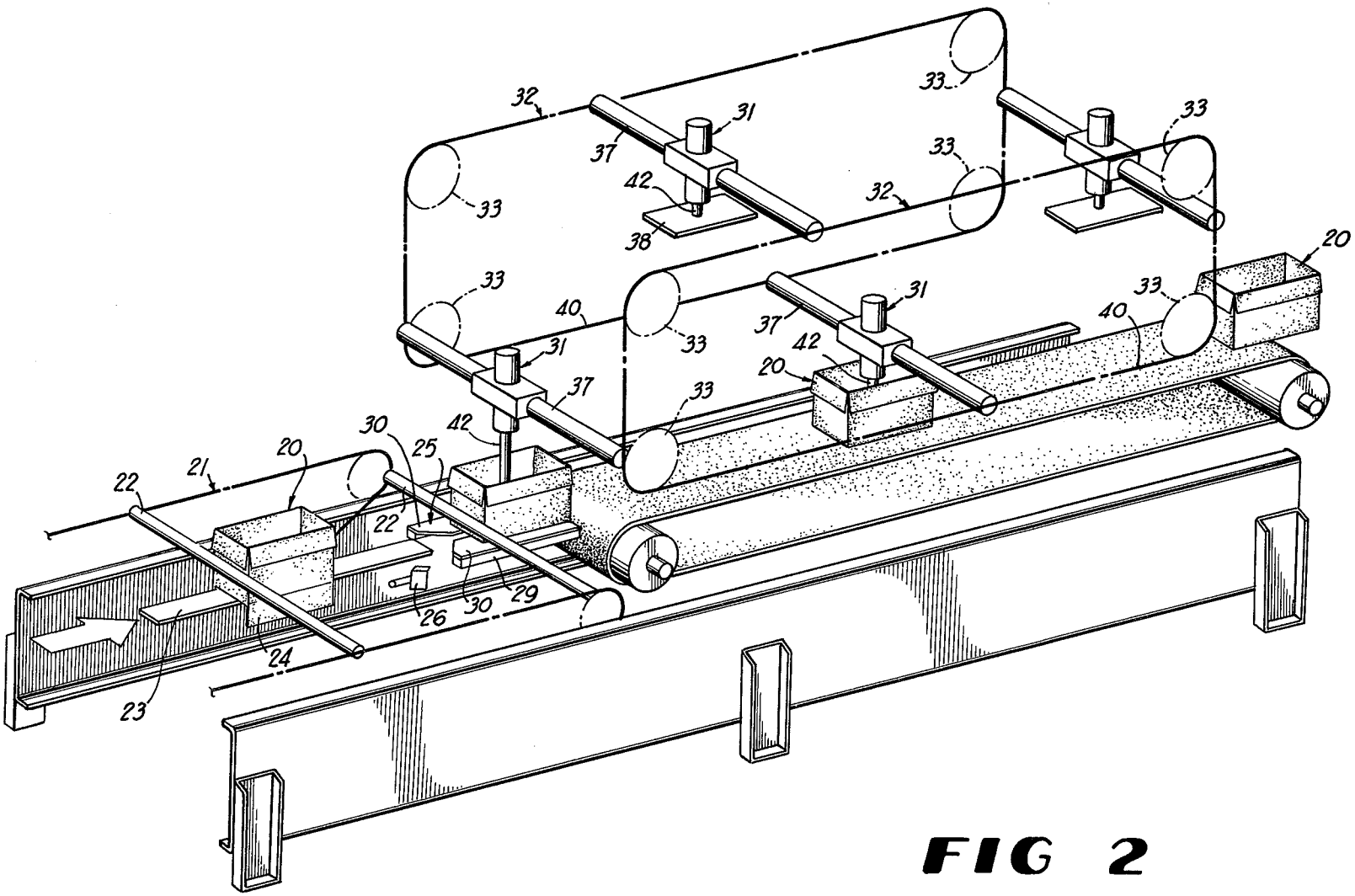
FIG. 2 is a partly schematic perspective view of the same.

Upon completion of this flap folding operation, the rocker shaft 28 turns the squaring stops 27 to horizontal positions, FIG. 4, and substantially simultaneously the carton 20 at station 25 is engaged by one of several flap compression power units 31 connected with and moving continuously with endless conveyor elements 32 arranged in vertical flights as depicted in FIGS. 1 and 2.

The conveyor flights 32 may be sprocket chains trained over an array of supporting sprocket gears 33, one of which is driven continuously by gearing 34, driven by additional gearing 35 from a suitable prime mover 36, FIG. 1.

The power units 31 are suspended on the conveyor elements 32 in equidistantly spaced relation by transverse suspension bars 37 or equivalent means. The units 31 are ram devices, pneumatically operated or otherwise operated in a known manner. The ram axes are maintained vertical at all times while the units are moving with the elements or chains 32 in the direction of the arrows.

Each unit 31 has an extensible and retractable level flap compression plate 38 which is capable of entering one of the empty cartons 30 at the station 25 and initiating movement of that particular empty carton onto a horizontal conveyor 39 which is being driven in the same direction and at the same speed as the lower runs 40 of conveyor flights 32 by additional gearing 41 connected with the prime mover 36, such as an electric motor and built-in speed reducer.

The movement of the units 31 with their conveyor elements 32 is properly timed with the delivery of empty cartons 20 to the squaring and flap folding station 25 so that a flap compression plate 38 may begin to enter the open top of a carton as one unit 31 is passing around the circumference of one lower pair of sprocket gears 33 with its suspension bar 37. Substantially simultaneously, the ram piston rod 42 of the particular unit 31 is extended to complete entry of the plate 38 into the empty carton 20.

The continuous movement of the unit 31 transfers the carton 20 from the station 25 onto the conveyor 39 which is traveling in the same direction and at the same speed as the unit 31. Fully extension of the rod 42 with flap compression plate 38 is illustrated in connection with the carton 20 which is completely on the horizontal conveyor 39 in FIG. 1. Initial and partial extension of the rod 42 with plate 38 is illustrated in dotted lines at the station 25 in FIG. 1.

When the movement of a unit 31 with conveyor flights 32 has transferred a particular carton 20 onto the upstream end of conveyor 39, full extension of the plate 38 will immediately begin to press the glued and folded outer flaps 24 against the conveyor 39 and such compression will be maintained during the movement of each carton 20 along the entire length of the conveyor 39 with the moving power unit 31. Thus, the previously-glued carton flaps 24 are compressed against the belt or conveyor 39 for a sufficient length of time to complete the sealing of the flaps, following which the rod 42 and compression plate 38 are retracted near the downstream end of the conveyor 39 and the power unit 31 separates completely from the associated carton 20 as it travels upwardly at the downstream vertical runs of the flights 32. The movement of the units 31 with the conveyor flights 32 is continuous, as previously stated, and each empty carton 20 is processed in the described manner by one of the oncoming power units 31 in a continuing process. The speed of operation of the carton advancing and sealing apparatus under the method is capable of keeping up with the speed of delivery of the empty cartons 20 by the high speed carton erecting apparatus of which the conveyor means 21 is a part.

As each unit 31 separates from a carton 20 near the downstream end of conveyor 39, the processed carton 20 slides onto a suitable apron 43 or other collection means.

The method is rapid and efficient and the apparatus involved is uncomplicated and economical.

Figure 5:
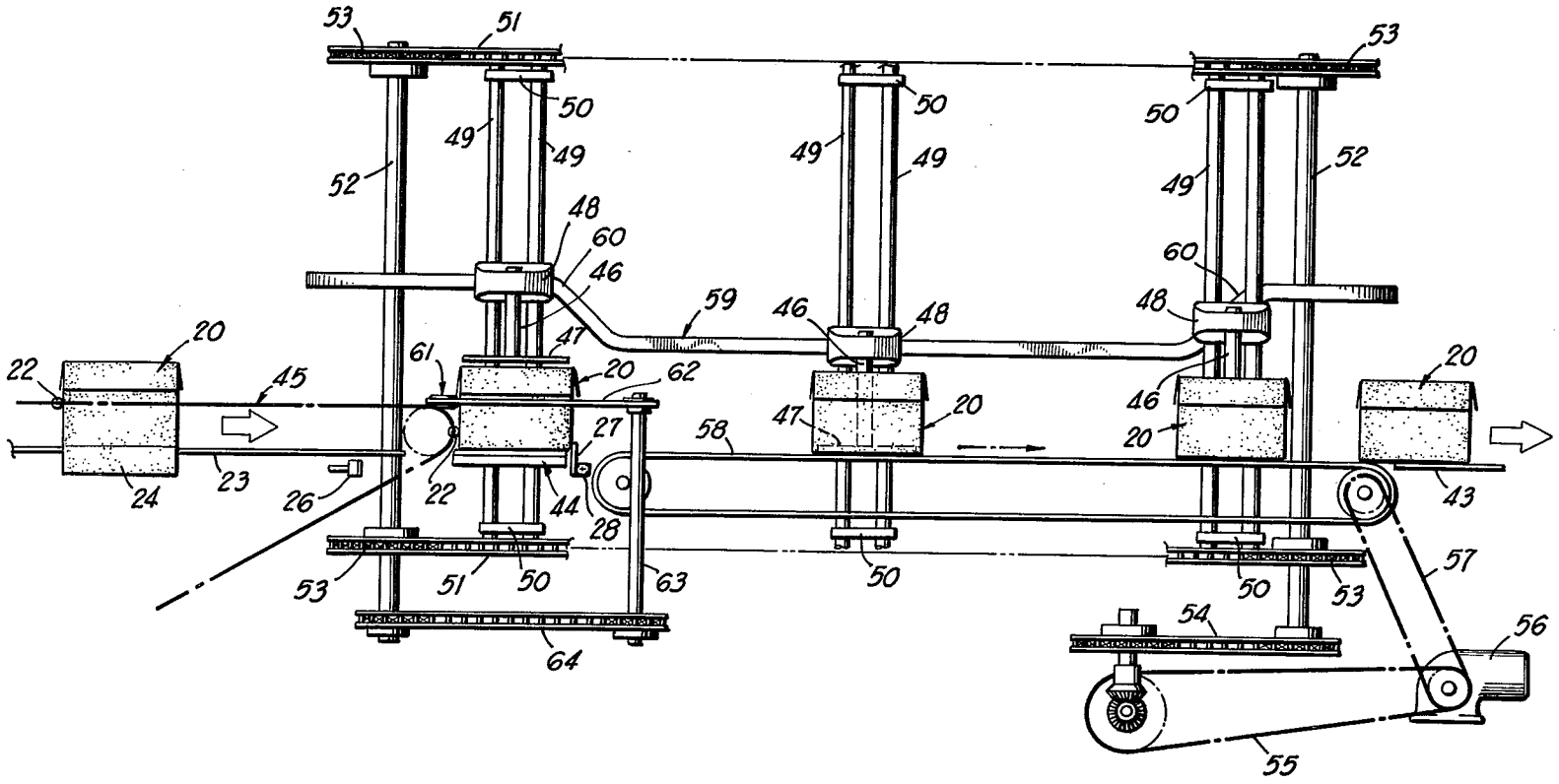
FIG. 5 is a side elevational view of continuous motion sealing apparatus according to a second embodiment of the invention.
Figure 6:
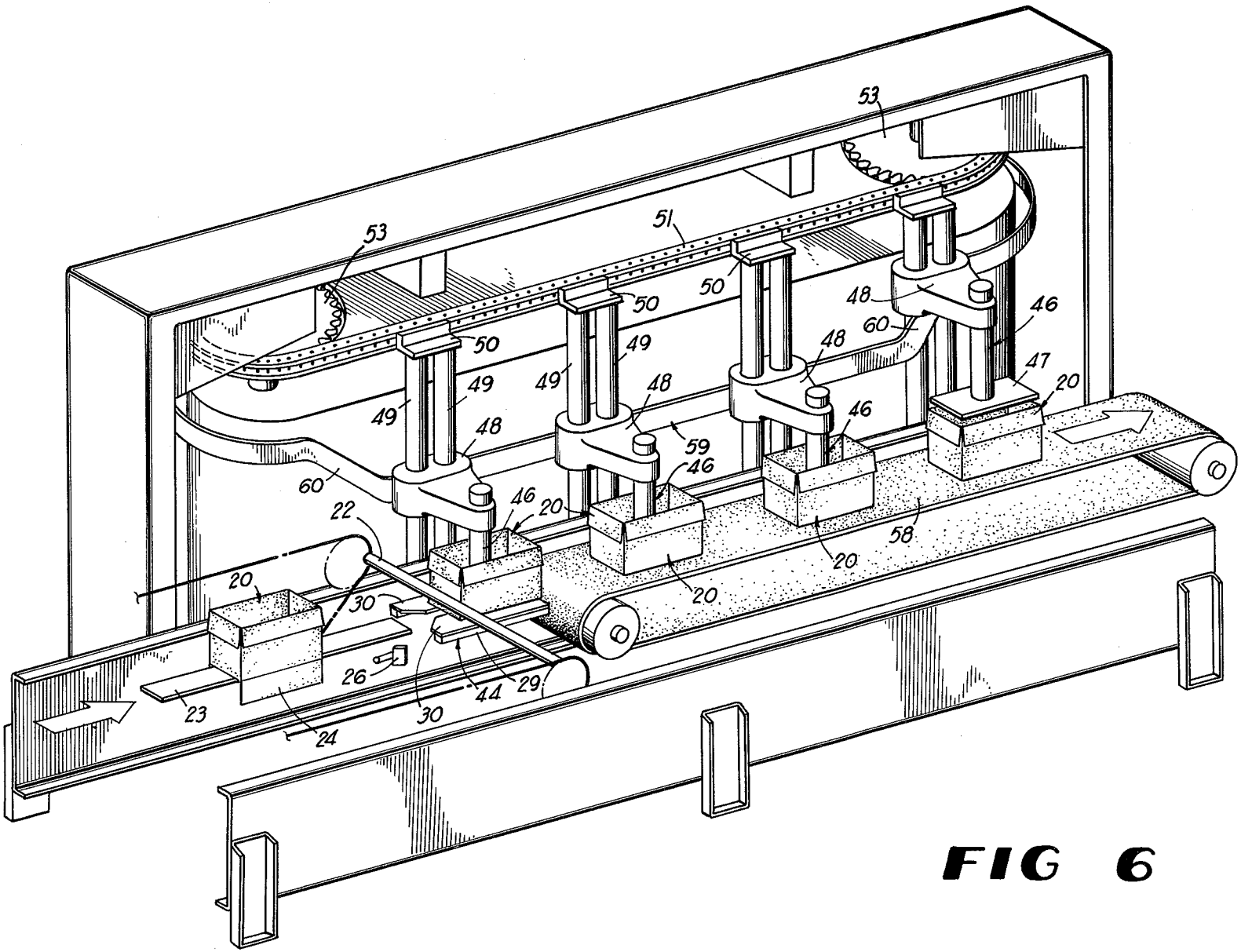
FIG. 6 is a perspective view of the second embodiment.
Figure 7:
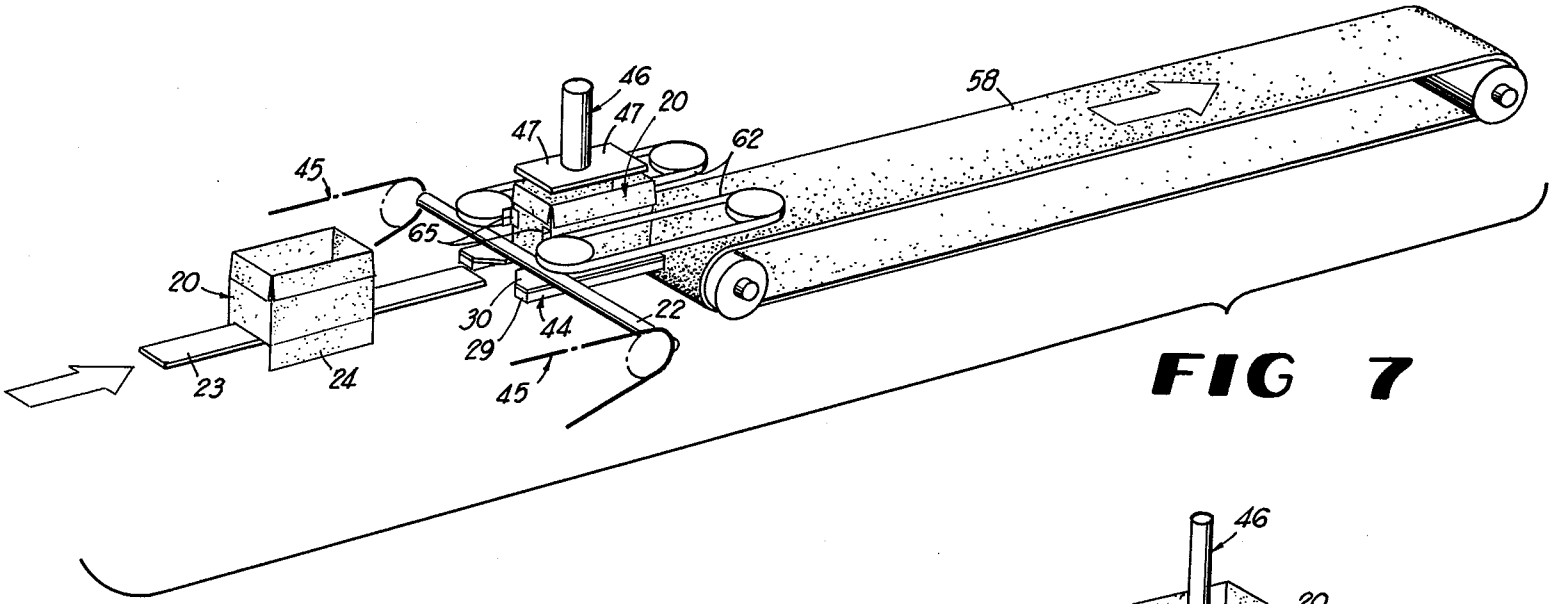
FIG. 7 is a fragmentary perspective view of a transfer and timing mechanism employed in conjunction with the embodiments of FIGS. 5 and 6.

A second embodiment of the invention is shown in FIGS. 5 through 7, and in these figures the same empty cartons 20 are received at a carton squaring and bottom flap folding station 44 from the discharge conveyor means 45 of the high speed carton erecting machine generally as shown and described in the prior embodiment. Glue is applied to the depending bottom carton flaps 24 by applicator means 26, as shown in the prior embodiment. However, as illustrated in FIGS. 5 through 7, the spaced power units 46 having horizontal flap compression plates 47 are carried by heads 48 which are vertically shiftably mounted on pairs of parallel vertical guide posts 49 having their top and bottom ends secured through crossheads 50 to endless chain flights 51 which move continuously and in unison in parallel horizontal planes, instead of vertically as in the prior embodiment. The horizontal flights 51 are connected with vertical shafts 52 having sprocket gears 53.

As shown in FIG. 5, the downstream shaft 52 is driven by additional horizontal gearing 54 from take-off gearing 55 connected with and driven by a prime mover 56 similar to the prime mover 36. Additional take-off gearing 57 connected with the prime mover 56 drives a horizontal carton conveyor 58 corresponding to the conveyor 39 of the prior embodiment and serving the same purpose in the invention.

The power units 46 and their heads 48 have their vertical movements along the guide posts 49 controlled by a stationary cam track 59 having inclined sections 60. The heads 48 are guidingly engaged with the cam track 59 to follow it while they travel continuously with the endless horizontal flights 51. The track 59 is profiled to cause the flap compression plates 47 to enter the cartons 20 at proper times and to separate from the cartons properly near the downstream end of the conveyor 58. The overall mode of operation in terms of the orderly advancement and the sealing of the bottom carton flaps 24 in the continuous motion apparatus and method is essentially unchanged in the second embodiment of FIGS. 5 through 7.

There is one additional feature in the second embodiment which is not present in the previous embodiment. As best shown in FIGS. 5 and 7, adjacent to the carton squaring and flap folding station 44, the apparatus includes a carton transfer and timing device 61. This device 61 includes spaced parallel horizontal carton transfer belts 62 driven in unison from a vertical jack shaft 63, FIG. 5, coupled with horizontal take-off gearing 64 driven by the adjacent shaft 52. The device 61 and its drive means is omitted from FIG. 6 for clarity.

The carton transfer and timing belts 62 are above the elevation of the flap folding blades 30 at station 44 and extend slightly fore and aft of each carton 20 at the station 44. The belts 62 are equipped with carton pusher lugs 65 which contact the upstream end wall of each carton after the squaring stops 27 are down and transfer each carton onto the moving belt 58 in properly timed relationship with the movement and descent of the flap compression plates 47 of units 46 and the linear movement of the conveyor 58 against which the bottom flaps are pressed by the plates 47. Unlike the prior embodiment, the horizontal movement of the power unit 46 is not relied upon to transfer the cartons from the rest station 44 onto the conveyor 58 and such transferring, as well as timing, is accomplished by the device 61.

Figure 8:
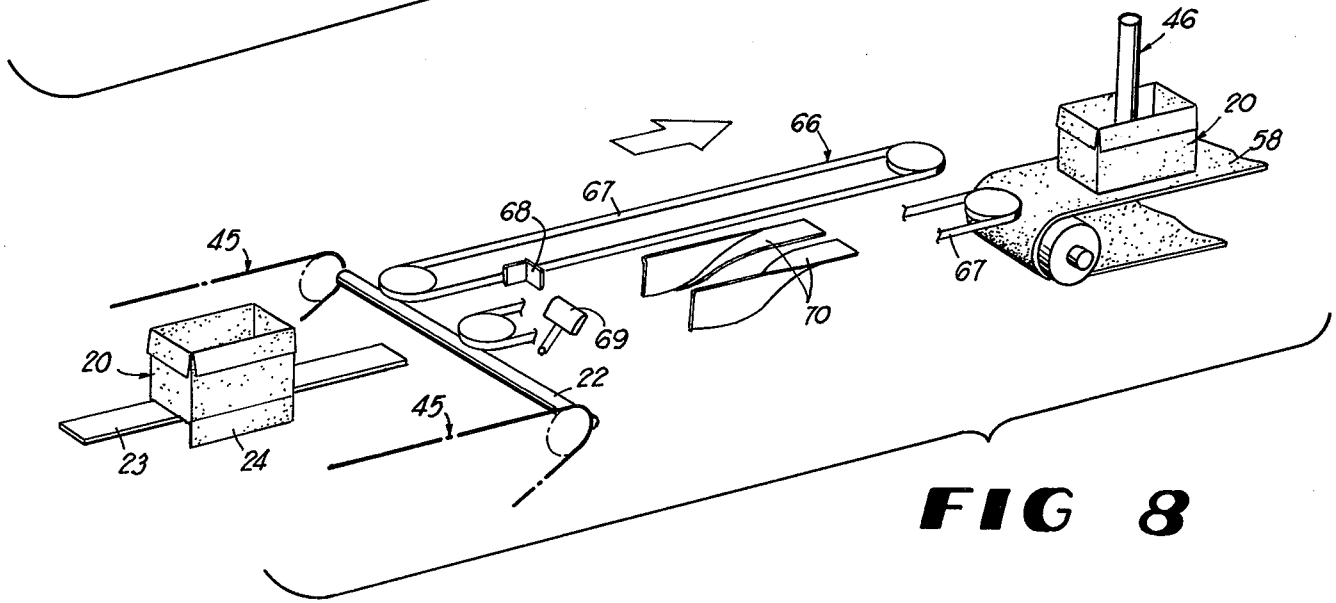
FIG. 8 is a similar perspective view showing a variant of the transfer and timing mechanism.

In FIG. 8, a variation of the arrangement in FIGS. 5 through 7 is shown. A transfer device 66 similar to the device 61 is provided between the conveyor 45 of the carton erecting machine and the bottom flap compression conveyor 58. The device 66 comprises parallel horizontal continuously moving belts 67 having carton pusher lugs 68 thereon to engage each carton 20 after it passes from the support element 23 under influence of the conveyor 45 and one of its pusher bars 22. As the belts 67 take over in transferring carton 20 toward the belt 58 in properly timed relationship to the movement of power units 46, glue is applied at 69 to the bottom faces of the two previously folded inner flaps on the bottom of the carton instead of to the depending outer flaps 24. Further movement of the carton 20 with the belts 67 brings the flaps 24 into engagement with a pair of fixed contoured flap folding cam rails 70 which accomplish the folding of the flaps 24 prior to the entry of the carton 20 onto the upstream end of the belt 58 where it continues to be engaged by one of the power units 46 having a flap compression plate 47 exactly as depicted in FIGS. 5 to 7.

The flap folding means 70 and glue applicator means 69 in FIG. 8 could also be employed in the prior embodiments, if desired, in lieu of the means 30 and 26. In all instances, the bottom flap sealing apparatus is simple and has a continuous motion and processes the cartons 20 with sufficient speed to prevent any pile-up of cartons coming out of the high speed carton erecting machine. The method is efficient and economical and constitutes a distinct improvement over prior art practices, for the above stated reasons and further because it produces a more reliable sealing of the bottom flaps 24.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. An apparatus for sealing the bottom flaps of cartons as they are delivered in succession from a carton erecting machine comprising carton squaring and bottom flap folding means near the delivery end of a carton erecting machine, a bottom flap support and compression conveyor moving away from said squaring and flap folding means and receiving cartons in succession from the latter with their bottom flaps closed and resting on said conveyor, and overhead endless path continuous motion means engageable with each carton substantially at said squaring and flap folding means and moving with each carton as the same travels with said bottom flap support and compression conveyor and engaging and exerting a continuing downward compressive force on the bottom flaps of the carton during such moving to complete the sealing of the bottom flaps, said continuous motion means then separating from each carton near the downstream end of said bottom flap support and compression conveyor.

2. An apparatus as defined in claim 1, and said overhead endless path continuous motion means including a plurality of spaced flap compression units traveling in unison and each having a lower end flap compression plate adapted to enter through the open top of an empty carton and press the bottom flaps of the carton against said bottom flap support and compression conveyor.

3. An apparatus as defined in claim 2, and each compression unit comprising a vertical axis ram device having an extensible and retractable rod carrying said lower end flap compression plate.

4. An apparatus as defined in claim 1, and said overhead endless path continuous motion means comprising an endless conveyor element traveling in a vertical plane and having plural spaced carton flap compression devices coupled thereto and moving continuously therewith and being adapted to enter empty cartons near one end of the bottom flap support and compression conveyor and to separate from the cartons near the other end of such conveyor.

5. An apparatus as defined in claim 2, and said overhead endless path continuous motion means including an endless conveyor element traveling in a vertical plane and carrying said flap compression units in equidistantly spaced relationship.

6. An apparatus as defined in claim 1, and said overhead endless path continuous motion means comprising a pair of vertically spaced endless conveyor elements traveling in unison in parallel horizontal planes, and spaced flap compression units connected between said spaced endless conveyor elements and continuously moving therewith and having vertically displaceable flap compression elements to enter the tops of carton and bear down on the bottom flaps of cartons while the cartons are resting on and moving with said bottom flap support and compression conveyor.

7. An apparatus as defined in claim 6, and stationary cam means adjacent to said continuous motion means engaging said spaced flap compression units and causing the latter to move downwardly and upwardly for entry into cartons and separation therefrom.

8. An apparatus as defined in claim 7, and said stationary cam means comprising a profiled cam track.

9. An apparatus as defined in claim 6, and said spaced flap compression units including vertical guideposts connected between said spaced endless conveyor elements and vertically shiftable flap compression heads having guided engagement with said posts.

10. An apparatus as defined in claim 1, and glue applicator means for applying glue to interior faces of carton bottom flaps upstream from said carton squaring and bottom flap folding means.

11. An apparatus for sealing the bottom flaps of cartons as they are delivered in succession from a high speed carton erecting machine comprising carton squaring and bottom flap folding means near the delivery end of a carton erecting machine, a bottom flap support and compression conveyor moving away from said squaring and flap folding means and receiving cartons in succession from the latter with their bottom flaps closed, overhead endless path continuous motion means engageable with each carton substantially at said squaring and flap folding means and moving with each carton as the same travels with said bottom flap support and compression conveyor and exerting a continuing downward compressive force on the bottom flaps of the carton during such moving to complete the sealing of the bottom flaps, said continuous motion means then separating from each carton near the downstream end of said bottom flap support and compression conveyor, and a horizontal endless belt carton transfer and timing device adjacent said bottom flap folding means engaging cartons and transferring them onto said bottom flap support and compression conveyor.

12. An apparatus as defined in claim 11, and said transfer and timing device having an associated underlying stationary bottom flap folding cam rail means.

13. In combination with a high speed carton erecting machine and for placement adjacent to the discharge end of such erecting machine where erected cartons are delivered with their bottom outer flaps coated with glue in an unfolded and unclosed condition, a continuous motion apparatus including means for closing said bottom outer flaps and for applying compression thereto over a considerable time interval while cartons are traveling with the continuous motion apparatus, said continuous motion apparatus being an endless path apparatus having spaced flap compression devices adapted to enter the tops of empty cartons as they rest upon said conveyor and to descend into compressive engagement with the carton bottom flaps, means to raise and lower said flap compression devices during movement thereof with said cartons, and a moving support bed for the bottoms of the cartons traveling in unison with and at the same speed as said continuous motion apparatus.

14. A continuous motion method of sealing the bottom flaps of cartons as the cartons are delivered in a regular succession from a high speed carton erecting machine comprising the steps of briefly interrupting the movement of each carton to square it in relation to its line of travel and folding and closing the bottom flaps of the carton while it is briefly interrupted, releasing the carton and engaging it with a continuous motion endless path bottom flap compression device by introducing such device through the open top of the carton and moving the device downwardly into compressive contact with the bottom of the carton, and substantially simultaneously supporting the bottom of the carton and moving the supported carton in the same direction and at the same speed as said continuous motion endless path compression device.

15. The method as defined in claim 14, and causing said continuous motion endless path compression device to travel downwardly for entry into the carton and then horizontally with the carton and then upwardly and away from the carton to separate the compression device therefrom following completion of the bottom flap sealing.

16. A method of sealing the bottom closure flaps of open top empty cartons comprising the steps of supporting open top empty cartons in spaced relation on a horizontally moving support which underlies folded and closed bottom carton flaps, and progressively moving plates respectively through the interior of said cartons for engaging the bottom carton flaps through the open tops of cartons while they are horizontally moving and being supported and for applying compression to the tops of the carton flaps in opposition to the horizontally moving support.

* * * * *